United States Patent [19]

Brite

[11] 4,097,936

[45] Jul. 4, 1978

[54] FLUSH TANK VAPORIZER

[76] Inventor: Alan D. Brite, 114 S. Canyon View Rd., Los Angeles, Calif. 90049

[21] Appl. No.: 708,740

[22] Filed: Jul. 26, 1976

Related U.S. Application Data

[63] Continuation-in-part of Ser. No. 611,446, Sep. 8, 1975, abandoned.

[51] Int. Cl.[2] ..... E03D 9/04; B67B 7/24

[52] U.S. Cl. ..... 4/228; 222/88

[58] Field of Search ..... 4/222, 227, 228, 231; 21/53, 74 R; 222/88, 373; 239/43

[56] References Cited

U.S. PATENT DOCUMENTS

| | | | |
|---|---|---|---|
| 1,134,556 | 4/1915 | Recker | 4/227 |
| 1,213,978 | 1/1917 | Thornton | 21/53 |
| 1,728,737 | 9/1929 | Stoner | 4/227 |
| 1,865,700 | 7/1932 | Lichter | 239/43 |
| 2,331,589 | 10/1943 | Addlesburger | 21/74 R X |
| 2,545,755 | 3/1951 | Word | 21/53 X |
| 2,921,832 | 1/1960 | Holther | 21/53 |
| 3,521,306 | 7/1970 | Jacobs | 4/228 |
| 3,760,433 | 9/1973 | Mallin | 4/228 |
| 3,914,805 | 10/1975 | Dolan | 4/227 |
| 3,929,260 | 12/1975 | Ernst | 222/88 |
| 3,953,902 | 5/1976 | Taylor | 4/227 |

*Primary Examiner*—Richard E. Aegerter
*Assistant Examiner*—Stuart S. Levy
*Attorney, Agent, or Firm*—Lyon & Lyon

[57] ABSTRACT

An apparatus for vaporizing wherein a vaporizer is positioned within a water closet so that the normal water level substantially fills a portion of the vaporizer. Upon discharging water from the water closet, the water level in the vaporizer falls thereby allowing air to enter the vaporizer. As the water level returns to its normal level within the water closet, the air in the vaporizer is forced into communication with a vaporizable compound and exits the vaporizer through an outlet into the atmosphere.

3 Claims, No Drawings

FLUSH TANK VAPORIZER

RELATED CASE

This application is a continuation-in-part of earlier filed United States Patent Application Ser. No. 611,446, filed Sept. 8, 1975 now abandoned.

BACKGROUND OF THE INVENTION

1. Field of the Invention

The invention relates to a method and apparatus of vaporizing to be utilized in conjunction with a commercial water closet.

2. Description of the Prior Art

Commercial vaporizers utilized in conjunction with water closets have taken several forms. Typical of such vaporizers is a liquid container having an exposed wick which emits vapors constantly. Similarly, evaporative cakes which decompose at a relatively uniform rate in the atmosphere have also been utilized. A common failure of such vaporizers is that due to the fact that they operate relatively constantly, their life is of a rather short duration, and they are utilized for extended periods of time when vaporization is not required. Other vaporizers utilize an enclosed wick, however, these vaporizers may become plugged in the wick interstices and thus, inoperable.

SUMMARY OF THE INVENTION

In accordance with the present invention, a method and apparatus for vaporizing are provided. The vaporizer is positioned within a water closet so that the normal water level substantially fills a portion of the vaporizer. Upon discharging water from the water closet, the water level in the vaporizer falls thereby allowing air to enter the vaporizer. As the water level returns to its normal level within the water closet, the air in the vaporizer is forced into communication with a vaporizable compound and exits the vaporizer through an outlet.

DESCRIPTION OF THE PREFERRED EMBODIMENTS

Figure 1:
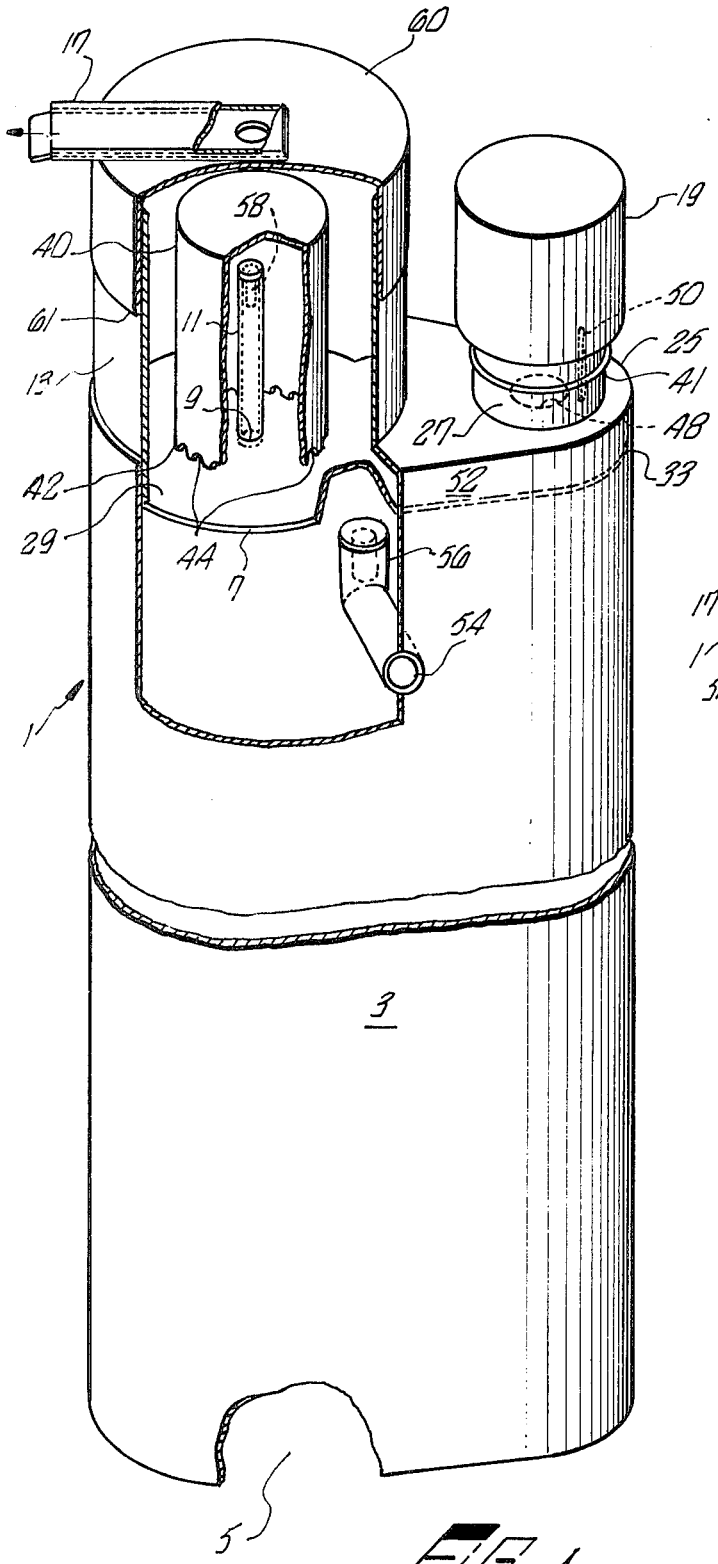
FIGS. 1 and 2 are perspective views in partial cross-section illustrating the vaporizer of the present invention.

Referring now to FIG. 1, a vaporizer generally referred to as 1 is illustrated. The vaporizer 1 may be comprised of a first chamber 3 having an inlet 5 which is preferably located at the base of the first chamber 3 and having a diameter substantially equal to the diameter of the first chamber 3. The upper portion of the first chamber 3 is sealed by means of a base 7 which has an aperture 9 located therein sufficient to allow for the insertion of a vertical inlet 11. The inlet 11 is positioned within a second chamber 13 and within an annular enclosure 40 having an open end 42, resting on base 7, the open end 42 of the enclosure 40 having a plurality of serrations 44. The second chamber 13 is further provided with an outlet passage 17. A second chamber top 60 may swivel about aperture 61 in order to properly position the outlet 17.

A separable reservoir 19 is positioned in communication with the second chamber 13. Reservoir 19 may be provided with a seal across an inlet 48 which is broken upon insertion into aperture 27 by means of a spike 50. Alternately, reservoir 19 may have a small diameter neck portion 41 thereby preventing spillage when it is mounted in the aperture 27. The enclosure 52 defined by base member 7, an annular ring 34 and an upper member 25 has apertures 29 and 27 located therein for the insertion of the second chamber 13 and the reservoir 19 respectively. Such an arrangement allows the reservoir 19 to discharge liquid into the enclosure 52 thereby allowing for the maintenance of a constant level of aromatic material in the second chamber 13.

In a preferred embodiment, an air inlet 54 and the second chamber inlet 11 are provided with one way valves 56 and 58 respectively which prevent the passage of fluid from the tank to the first chamber and the second chamber 13 to the first chamber 3 respectively.

Figure 2:
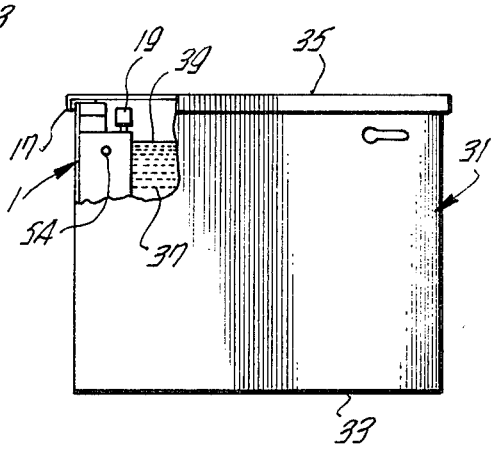

Having defined the vaporizer in detail, its method of operation will now be discussed with reference to FIG. 2. In this figure the vaporizer 1 is shown to be positioned within a water closet tank 31 having a water reservoir 33 and a top member 35. The water closet 31 is shown to be partially filled with water 37 to a normal water level 39.

When a volume of water 37 is discharged from the water closet 31 the water level drops below the inlet 54 and/or 5 of the first chamber 3 thereby allowing air to fill the volume of the first chamber 3. As water enters and fills the water closet 31, again establishing the normal water level 39, the air contained within the first chamber 3 is forced through the inlet 11 into the second chamber 13 containing the aromatic compound and out through the second chamber outlet 17 and into the atmosphere.

Further, the reservoir 19, which may be separable, may be replaced when it has expended all of the material contained therein (aromatic or sanitizing compounds in preferred embodiments) into the enclosure 52 and the second chamber 13. Such a separation of the reservoir 19 and the balance of the vaporizer 1 allows for the main body of the vaporizer 1 to be utilized with a successive number of reservoirs. The same reservoir 19 may be simply refilled and reutilized or simply replaced. It is noted that the liquid level is maintained in the reservoir 19 at a level higher than the top 25 of the enclosure 52 so that as the vaporizable material is forced into the atmosphere with a charge of air passing through chambers 3 and 13, the liquid level in the reservoir 19 is decreased.

Such a vaporizer allows for controlling the vaporization to be accomplished only at the specific time when the water closet is utilized. Such a method of operation allows for the extended life of the vaporizer without utilization of the vaporizing feature when it is not needed.

Although preferred embodiments of this invention have been described, it will be readily apparent that alteration and modification may be resorted to without departing from the scope of the invention. Such alterations and modifications are intended to be included within the scope of the appended claims.

What is claimed is:

1. A vaporizer adaptable for insertion into a water closet tank comprising:

a first chamber being in communication with the varying water level of a water closet tank;

a second chamber having an inlet extending vertically into said second chamber, said inlet extending through the base of said second chamber, said second chamber with said base separating the first and second chambers being further defined as having an outlet to the atmosphere; an enclosure bounded by the base of said second chamber, an annular ring and a top member, said enclosure being in communication with said second chamber, a separable reservoir in communication with said enclosure;

an air inlet entending through the upper portion of said first chamber, said air inlet being in communication with said first chamber and said tank, said air inlet including a one way valve so that air flow may only occur from said tank to said first chamber; an annular enclosure open at one end positioned on said second chamber base and about said second chamber inlet, said enclosure open end being serrated, said second chamber inlet including a one way valve so that fluid flow may occur from the second chamber inlet into said annular enclosure.

2. The vaporizer claimed in claim 1 wherein said first chamber has an inlet positioned adjacent the lower portion of said first chamber and being in communication with the varying water level of said water closet, and said first chamber inlet has a diameter substantially equal to the diameter of said first chamber.

3. The vaporizer claimed in claim 1 wherein a said separable reservoir is provided with an inlet covered with a thin covering and said vaporizer is provided with a spike to pierce said reservoir inlet covering when said reservoir is connected to said vaporizer.

* * * * *